US005284494A

United States Patent [19]

Baillargeon et al.

[11] Patent Number: 5,284,494

[45] Date of Patent: * Feb. 8, 1994

[54] OLIGOMERIC/POLYMERIC MULTIFUNCTIONAL ADDITIVES TO IMPROVE THE LOW-TEMPERATURE PROPERTIES OF DISTILLATE FUELS

[75] Inventors: David J. Baillargeon, Cherry Hill; Angeline B. Cardis, Florence; Dale B. Heck, West Deptford, all of N.J.; Susan W. Johnson, Centreville, Va.

[73] Assignee: Mobil Oil Corporation, Fairfax, Va.

[ * ] Notice: The portion of the term of this patent subsequent to Nov. 30, 2010 has been disclaimed.

[21] Appl. No.: 946,216

[22] Filed: Sep. 17, 1992

[51] Int. Cl.[5] ..... C10L 1/18

[52] U.S. Cl. ..... 44/386; 44/389; 44/391; 44/392; 44/393

[58] Field of Search ..... 44/386, 393

[56] References Cited

U.S. PATENT DOCUMENTS 5,112,937 5/1992 Garapon et al. ..... 44/390

5,156,655 10/1992 Baillargeon et al. ..... 44/405

*Primary Examiner*—Ellen M. McAvoy

*Attorney, Agent, or Firm*—Alexander J. McKillop; Malcolm D. Keen; Howard M. Flournoy

[57] ABSTRACT

Additives which improve the low-temperature properties of distillate fuels are oligomeric/polymeric reaction products consisting of cross-linked anhydride and cross-linked epoxide (or their corresponding acid/diol equivalents), with optional termonomers.

23 Claims, No Drawings

OLIGOMERIC/POLYMERIC MULTIFUNCTIONAL ADDITIVES TO IMPROVE THE LOW-TEMPERATURE PROPERTIES OF DISTILLATE FUELS

CROSS-REFERENCE TO RELATED APPLICATIONS

This application is related to pending application Ser. No. 07/620,799, filed Dec. 3, 1990, now U.S. Pat. No. 5,129,917.

BACKGROUND OF THE INVENTION

Field of the Invention

This application is directed to oligomeric/polymeric multifunctional additives comprising epoxide cross-linked materials, and anhydride cross-linked materials useful for improving the low-temperature properties of distillate fuels and to fuel compositions containing same.

Description of Related Art

Traditionally, the low-temperature properties of distillate fuels have been improved by the addition of kerosene, sometimes in very large amounts (5–70 wt %). The kerosene dilutes the wax in the fuel, i.e., lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity; however, most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

BRIEF SUMMARY OF THE INVENTION

Novel polyester and modified polyester oligomers/polymers comprising anhydrides and long-chain epoxides cross-linked with polyepoxides, activated epoxides, polyanhydrides, or activated anhydrides have been prepared and have been found to be surprisingly active wax crystal modifier additives for distillate fuels. Activated epoxides as used herein refers to epoxides wherein the 3-position of the carbon not attached to oxygen has a reactive substituent thereon as in, for example, epichlorhydrin. Activated anhydride as used herein is an anhydride having alpha-beta unsaturation such as maleic anhydride. Distillate fuel compositions containing $\leqq 0.1$ wt % of such additives demonstrate significantly improved low-temperature flow properties, i.e., lower cloud point and lower CFPP filterability temperature.

These additives are oligomeric and/or polymeric ester products which have linear hydrocarbyl pendant groups attached to the backbone of the oligomeric/polymeric structure. These esters are derived from the polymerization of a suitable combination of monomers which include (1) one or more long-chain epoxides, (2) one or more anhydrides, and (3) a reactive material, e.g., epoxy halides, diepoxides, dianhydrides, etc., which function as crosslinking agents. Optionally, other reactive materials may also be added and which may function as a chain transfer agent, chain terminator, chain propagator, or chain cross-linking agent. Alternatively, condensation reaction with removal of water or other such by-product may be employed to make the same oligomeric/polymeric esters from a monomer mixture which may include (1) one or more diols, (2) one or more diacid equivalents (anhydride, diacid, diacid chloride, etc.), and (3) the same reactive materials listed above.

Additionally, the oligomeric and/or polymeric ester products, derived as described above, may be further reacted with additional reagents in a second synthetic step so as to derivatize, cap, or otherwise modify reactive end groups or other pendant groups incorporated along the backbone of the original oligomeric/polymeric ester. These additional reagents may include, for example, amines or alcohols which would serve to convert residual acids and anhydrides in the oligomeric/polymeric ester product to alternate carboxyl derivatives such as amides, imides, salts, esters, etc. Similarly, residual epoxides would be converted to amine and ether adducts. These examples serve to illustrate, but not limit, the concept of post-reacting the original oligomeric/polymeric ester product to modify its original chemical functionality.

These oligomeric/polymeric esters are structurally very different from the known categories of polymeric wax crystal modifiers. Known polymeric wax crystal modifiers are generally radical-chain reaction products of olefin monomers, with the resulting polymer having an all-carbon backbone. The materials of this invention are condensation products of long-chain epoxides (at least $C_{12}$) or corresponding diols and anhydrides or acid equivalents to give polymeric structures where ester functions are regularly spaced along the polymer backbone.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

The compositions of these additives are unique. Also, the additive concentrates and fuel compositions containing such additives are unique. Similarly, the processes for making these additives, additive concentrates, and fuel compositions are unique.

The primary object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

DESCRIPTION OF THE PREFERRED EMBODIMENTS

The additives of this invention have comb-like structures, where a critical number of linear hydrocarbyl groups are attached to the backbone of an oligomeric/polymeric polyester. These additives are reaction products obtained by combining two, or optionally more, monomers and a suitable crosslinking agent in differing ratios using standard techniques for condensation polymerization. These wax crystal modifiers which are effective in lowering cloud point are generally characterized as crosslinked alternating co-oligomers/copolymers (or optionally terpolymers, etc.) of the following type:

$$(-A-B-C-)_n$$

where $n \geqq 1$

One combination of monomers may include (A) one or more anhydrides, (B) one or more long-chain epoxides, and (C) a reactive material, e.g., epoxy halides, diepoxides, dianhydrides, etc., as crosslinking agents. Other optional reactive materials which may function as chain transfer agents, chain terminators, chain propagators, or chain cross-linking agents may also be added. Alternatively, a second combination of monomers, in which the removal of a low molecular weight by-product accompanies the condensation reaction, may include (A) one or more diacid equivalents (anhydride, diacid, diacid chloride, etc.), (B) one or more long-chain diols, and (C) the same reactive materials listed above. Comonomer stoichiometry may vary widely with A:B=1:2 to 2:1, or preferably A:B=1:1.5 to 1.5:1, or most preferably A:B=1:1.1 to 1.1:1. Crosslinking agent and optional termonomers, component C, may substitute for some fraction of A or B in the above stoichiometric ranges.

The pendant linear hydrocarbyl groups are carried by at least one, and optionally by more than one, of the monomers. These critical linear pendant hydrocarbyl groups are generally $C_{12}$ or longer.

Additives of this invention may be grouped into categories based on distinct structural and compositional differences, described below. Preparation of selected additives are given in EXAMPLES 1-3. Additive compositions and their respective performance for cloud point and CFPP are given in TABLES 1 and 2.

Category A: Epoxide Cross-Linked Compositions (TABLE 1)

Successful wax crystal modifier additives may be cross-linked ABC-type oligomers/polymers which can be prepared from an anhydride (A monomer), a long-chain epoxide (B monomer), and a polyepoxide (C monomer) using an amine catalyst. The polyepoxide is a cross-linking agent and may be a diepoxide, triepoxide, tetraepoxide, etc., with the diepoxide being the most commonly used. Any of the anhydride/epoxide compositions described previously are suited to this additional modification. The polyepoxide cross-linker may have virtually any molecular structure, and may be present at 0.001 wt % or higher. For example, the polyepoxides may include alkyl diepoxides, e.g., linear diglycidyl ether, Entry 85; or, branched diglycidyl ether, Entries 86-87, 93, 98-99, 102-103, ether-containing diepoxides, e.g., glycol-type diglycidyl ethers, Entries 88-90, 94, 100, 104, aromatic-containing diepoxides, e.g., bisphenol A diglycidyl ether, Entries 91-92, 95, 101, 105, or alkyl triepoxide, e.g., alkyl triglycidyl ether, Entries 96-97.

A typical synthesis is illustrated by the phthalate co-oligomer/copolymer cross-linked by a branched alkyl diepoxide, Entry 86, in EXAMPLE 1.

Category B: Activated Epoxide Cross-Linked Compositions (TABLE 1)

Successful wax crystal modifier additives may be cross-linked ABC-type oligomers/polymers which can be prepared from an anhydride (A monomer), a epoxide (B monomer), and an activated epoxide (C monomer) using an amine catalyst. The activated epoxides are cross-linking agents and are any of those epoxides substituted at a beta carbon with a good leaving group (e.g. halogen, ester, ether, sulfonate, etc.); this provides two reactive sites in the same molecule. Epichlorhydrin is a good example of such an activated epoxide. Any of the anhydride/epoxide compositions described previously are suited to this additional modification. The activated epoxide cross-linker may have virtually any molecular structure, and may be present at 0.001 wt % or higher. For example, the activated epoxides may include a halo-epoxide (e.g. epichlorohydrin, Entries 106-110).

A typical synthesis is illustrated by the phthalate co-oligomer/copolymer cross-linked by epichlorohydrin, Entry 107, in EXAMPLE 2.

Category C: Anhydride Cross-linked Compositions (TABLE 2)

Successful wax crystal modifier additives may be cross-linked ABC-type oligomers/polymers which can be prepared from an anhydride (A monomer), a polyanhydride or other activated anhydride (C monomer), and a long-chain epoxide (B monomer) using an amine catalyst. The polyanhydrides, or other activated anhydrides, are cross-linking agents. Of the polyanhydrides, the dianhydrides are most commonly used, with benzophenone tetracarboxylic dianhydride (BTDA) as a typical example. A good example of an activated anhydride is maleic anhydride, with it activated olefin as its second reactive functional group. These doubly reactive anhydride cross-linkers may have virtually any molecular structure, and may be present at 0.001 wt % or higher. Any of the anhydride/epoxide compositions described previously are suited to this additional modification. For example, the polyanhydrides may include aromatic dianhydrides, e.g., pyromellitic dianhydride, Entries 111-112; benzophenone tetracarboxylic dianhydride, Entries 113-114, 120, 122-123, or alkyl dianhydrides, e.g., Epiclon B4400, Entries 118-119. As another example, the activated anhydrides may include 1,2-unsaturated anhydrides, e.g., maleic anhydride, Entries 115-116, 121.

Generally speaking, the reaction conditions may vary widely with molar ratios varying from equimolar to less than molar to more than molar, at pressures which may be autogenous or vary from atmospheric to slightly higher (about up to 100 psi), at temperatures varying from about 50 to about 250° C. and times from about an hour to 48 hours or more.

A typical synthesis is illustrated by the phthalate co-oligomer/copolymer cross-linked by pyromellitic dianhydride (PMDA), Entry 111, in EXAMPLE 3.

EXAMPLE 1

Preparation of Additive Entry 86

Phthalic anhydride (29.6 g, 0.20 mol; e.g., from Aldrich Chemical Co.), 1,2-epoxyoctadecane (62.7 g, 0.22 mol; e.g., Vikolox 18 from Viking Chemical), neopentanediol diglycidyl ether (1.08 g, 0.0050 mol; e.g., AZEPOXY N from Sherex Polymers Inc.), and 4-dimethylaminopyridine (0.10 g, 0.0008 mol; e.g., DMAP from Nepera, Inc.) were combined and heated at 110° C./5.5 hours and 140° C./1 hour. The reaction mixture was then hot filtered through a mixed bed of alumina (approximately 20%) and Celite to give 73.3 g of the final product.

EXAMPLE 2

Preparation of Additive Entry 107

Phthalic anhydride (29.6 g, 0.20 mol; e.g., from Aldrich Chemical Co.), epichlorohydrin (0.46 g, 0.005 mol; e.g., from Aldrich Chemical Co.), 1,2-epoxyoctadecane (57.0 g, 0.20 mol; e.g., Vikolox 18 from Viking Chemical), and 4-dimethylaminopyridine (0.10 g, 0.0008 mol; e.g., DMAP from Nepera, Inc.) were combined and heated at 110° C./5 hours and 140° C./1 hour. The reaction mixture was then hot filtered through a mixed bed of alumina (approximately 20%) and Celite to give 72.3 g of the final product.

EXAMPLE 3

Preparation of Additive Entry 111

Phthalic anhydride (29.6 g, 0.20 mol; e.g., from Aldrich Chemical Co.), pyromellitic dianhydride (0.44 g, 0.002 mol; e.g., PMDA from Allco Chemical Co.), 1,2-epoxyoctadecane (57.0 g, 0.20 mol; e.g., Vikolox 18 from Viking Chemical), and 4-dimethylaminopyridine (0.10 g, 0.0008 mol; e.g., DMAP from Nepera, Inc.) were combined and heated at 110° C./5 hours and 140° C./1 hour. The reaction mixture was then hot filtered through a mixed bed of alumina (approximately 20%) and Celite to give 71.7 g of the final product.

PREPARATION OF ADDITIVE CONCENTRATE

A concentrate solution of 100 ml total volume was prepared by dissolving 10 g of additive in mixed xylenes solvent. Any suitable hydrocarbon solvent, such as mixed xylene or toluene, may be used. Any isoluble particulates in the additive concentrate were removed by filtration before use.

TEST FUEL

The following test fuel was used for the screening of additive activity:

| FUEL: | | |
|---|---|---|
| API Gravity | 31.5 | |
| Cloud Point (°F.) | 21.4 | |
| CFPP (°F.) | 14 | |
| Pour Point (°F.) | 10 | |
| Distillation (°F.; D 86) | IBP | 340 |
| | 10% | 439 |
| | 50% | 534 |
| | 90% | 640 |
| | FBP | 693 |

TEST PROCEDURES

The cloud point of the additized distillate fuel was determined using an automatic cloud point test based on the commercially available Herzog cloud point tester; test cooling rate is approximately 1° C./minute. Results of this test protocol correlate well with ASTM D2500 methods. The test designation (below) is "HERZOG".

The low-temperature filterability was determined using the Cold Filter Plugging Point (CFPP) test. This test procedure is described in "Journal of the Institute of Petroleum", Volume 52, Number 510, June 1966, pp. 173–185.

Test results are recorded in Tables 1–2.

The products of this invention represent a significant new generation of wax crystal modifier additives which are dramatically more effective than may previously known additives. They represent a viable alternative to the use of kerosene in improving diesel fuel low-temperature performance.

TABLE 1

CROSS-LINKED CONDENSATION POLYESTERS
CATAGORY A: POLYEPOXIDE CROSS-LINKING AGENTS.

| ENTRY | EPOXIDE | CROSS-LINKING AGENT | ANHYDRIDE | MOLE RATIO | PERFORMANCE IMPROVEMENT (F.): CLOUD POINT (HERZOG) | CFPP |
|---|---|---|---|---|---|---|
| | | | FUEL B; 1000 ppm ADDITIVE | | | |
| 85 | VIKOLOX 18 | ARALDITE RD-2 | PHTHALIC ANHY | 1/0.025/1 | 4.9 | 9 |
| 86 | VIKOLOX 18 | AZEPOXY N | PHTHALIC ANHY | 1/0.025/1 | 5.1 | 11 |
| 87 | VIKOLOX 18 | AZEPOXY N | PHTHALIC ANHY | 1/0.05/1 | 4.7 | 9 |
| 88 | VIKOLOX 18 | DER 736 | PHTHALIC ANHY | 1/0.025/1 | 4.5 | 11 |
| 89 | VIKOLOX 18 | DER 732 | PHTHALIC ANHY | 1/0.025/1 | 6 | 7 |
| 90 | VIKOLOX 18 | DER 732 | PHTHALIC ANHY | 1/0.05/1 | 5.6 | — |
| 91 | VIKOLOX 18 | EPON 828 | PHTHALIC ANHY | 1/0.01/1 | 6.2 | 9 |
| 92 | VIKOLOX 18 | EPON 828 | PHTHALIC ANHY | 1/0.025/1 | 5.4 | — |
| 93 | VIKOLOX 14–20 | AZEPOXY N | PHTHALIC ANHY | 1/0.025/1 | 3.8 | 0 |
| 94 | VIKOLOX 14–20 | DER 732 | PHTHALIC ANHY | 1/0.02/1 | 3.8 | 0 |
| 95 | VIKOLOX 14–20 | EPON 828 | PHTHALIC ANHY | 1/0.02/1 | 3.8 | 2 |
| 96 | VIKOLOX 18 | EPICLON 725 | PHTHALIC ANHY | 1/0.02/1 | 5.3 | 4 |
| 97 | VIKOLOX 18 | EPICLON 725 | PHTHALIC ANHY | 1/0.04/1 | 4.4 | 2 |
| 98 | VIKOLOX 18 | AZEPOXY N | AC-METHYL | 1/0.025/1 | 4.4 | 0 |
| 99 | VIKOLOX 18 | AZEPOXY N | AC-METHYL | 1/0.05/1 | 5.1 | 4 |
| 100 | VIKOLOX 18 | DER 732 | AC-METHYL | 1/0.02/1 | 4.2 | 0 |
| 101 | VIKOLOX 18 | EPON 828 | AC-METHYL | 1/0.02/1 | 3.2 | 2 |

TABLE 1-continued

CROSS-LINKED CONDENSATION POLYESTERS
CATAGORY A: POLYEPOXIDE CROSS-LINKING AGENTS.

| ENTRY | EPOXIDE | CROSS-LINKING AGENT | ANHYDRIDE | MOLE RATIO | PERFORMANCE IMPROVEMENT (F.): CLOUD POINT (HERZOG) | CFPP |
|---|---|---|---|---|---|---|
| 102 | VIKOLOX 18 | AZEPOXY N | C18-24 SUCCINIC ANHY | 1/0.025/1 | 4.3 | 4 |
| 103 | VIKOLOX 18 | AZEPOXY N | C18-24 SUCCINIC ANHY | 1/0.05/1 | 4.1 | 4 |
| 104 | VIKOLOX 18 | DER 732 | C18-24 SUCCINIC ANHY | 1/0.02/1 | 5.2 | 4 |
| 105 | VIKOLOX 18 | EPON 828 | C18-24 SUCCINIC ANHY | 1/0.02/1 | 5 | 4 |

TABLE 2

CROSS-LINKED CONDENSATION POLYESTERS.
CATEGORIES B, C (See below).

| ENTRY | EPOXIDE | CROSS-LINKING AGENT | ANHYDRIDE | MOLE RATIO | PERFORMANCE IMPROVEMENT (F.): CLOUD POINT (HERZOG) | CFPP |
|---|---|---|---|---|---|---|
| | | CATEGORY B: ACTIVATED EPOXIDE CROSS-LINKING AGENTS FUEL B; 1000 ppm ADDITIVE | | | | |
| 106 | VIKOLOX 18 | EPICHLOROHYDRIN | PHTHALIC ANHY | 1/0.01/1 | 6 | 7 |
| 107 | VIKOLOX 18 | EPICHLOROHYDRIN | PHTHALIC ANHY | 1/0.025/1 | 5.8 | — |
| 108 | VIKOLOX 14-20 | EPICHLOROHYDRIN | PHTHALIC ANHY | 1/0.02/1 | 3.3 | 0 |
| 109 | VIKOLOX 18 | EPICHLOROHYDRIN | AC-METHYL | 1/0.02/1 | 3.4 | 0 |
| 110 | VIKOLOX 18 | EPICHLOROHYDRIN | C18-24 SUCCINIC ANHY | 1/0.02/1 | 5 | 5 |
| | | CATAGORY C: ANHYDRIDE CROSS-LINKING AGENTS FUEL B; 1000 ppm ADDITIVE | | | | |
| 111 | VIKOLOX 18 | PMDA | PHTHALIC ANHY | 1/0.01/1 | 5.8 | 7 |
| 112 | VIKOLOX 18 | PMDA | PHTHALIC ANHY | 1/0.025/1 | 5.3 | — |
| 113 | VIKOLOX 18 | BTDA | PHTHALIC ANHY | 1/0.025/1 | 5.3 | — |
| 114 | VIKOLOX 18 | BTDA | PHTHALIC ANHY | 1/0.05/1 | 4.9 | — |
| 115 | VIKOLOX 18 | MALEIC ANHY | PHTHALIC ANHY | 1/0.025/1 | 5.6 | — |
| 116 | VIKOLOX 18 | MALEIC ANHY | PHTHALIC ANHY | 1/0.05/1 | 5.4 | — |
| 117 | VIKOLOX 18 | MALEIC ANHY | PHTHALIC ANHY | 1/0.3/0.7 | 4.5 | 5 |
| 118 | VIKOLOX 18 | EPICLON B4400 | PHTHALIC ANHY | 1/0.025/1 | 5.8 | 4 |
| 119 | VIKOLOX 18 | EPICLON B4400 | PHTHALIC ANHY | 1/0.05/1 | 5.4 | 4 |
| 120 | VIKOLOX 14-20 | BTDA | PHTHALIC ANHY | 1/0.02/1 | 4 | 2 |
| 121 | VIKOLOX 14-20 | MALEIC ANHY | PHTHALIC ANHY | 1/0.02/1 | 3.3 | 0 |
| 122 | VIKOLOX 18 | BTDA | AC-METHYL | 1/0.02/1 | 2.9 | 2 |
| 123 | VIKOLOX 18 | BTDA | C18-24 SUCCINIC ANHY | 1/0.02/1 | 4.8 | 4 |

APPENDIX 1. GLOSSARY

| | |
|---|---|
| AC-Methyl: | 1-methyl-5-norbornene-2,3-dicarboxylic anhydride |
| Araldite RD-2: | 1,4-butanediol diglycidyl ether |
| Azepoxy N: | neopentanediol diglycidyl ether; 2,2-dimethyl-1,3-propanediol diglycidyl ether |
| BTDA: | 3,3',4,4'-benzophenonetetracarbyoxylic dianhydride |
| DER 732: | Dow Epoxy Resin 732; polypropylene glycol diglycidyl ether, average MW = 630 |
| DER 736: | Dow Epoxy Resin 736; polypropylene glycol diglycidyl ether, average MW = 380 |
| DMAP: | 4-dimethylamino-pyridine |
| Epichlorohydrin: | 3-chloro-1,2-epoxypropane |
| Epiclon 725: | trimethyl propane triglycidyl ether |
| Epon 822: | bis-phenol A diglycidyl ether |
| Herzog: | cloud point test; Herzog method |
| Phthalic anhydride: | 1,2-benzenedicarboxylic anhydride |
| PMDA: | pyromellitic dianhydride |
| Pyromellitic dianhydride: | 1,2,4,5-benzene tetracarboxylic dianhydride |
| Vikolox "N": | Linear 1,2-epoxyalkane, where N = the carbon number of the alkyl chain; N = 12, 14, 16, 18, 20, 20-24, 24-28, 30+. |

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. A multifunctional low-temperature-modifying distillate fuel additive consisting of a polymeric and/or oligomeric ester additive product of reaction consisting of epoxide cross-linked or anhydride cross-linked oligomers/polymers prepared by polymerizing or oligomerizing a suitable combination of monomers selected from the group consisting of (1) one or more long-chain epoxides or diol equivalents, (2) one or more anhydrides or diacid equivalents, (3) one or more crosslinking agents selected from the group consisting of (a) polyepoxides or polydiol equivalents or (b) one or more polyanhydrides or diacid equivalents, and (4) optionally a suitable reactive material selected from the group consisting of epoxy halides, diepoxides, dianhydrides, in varying molar ratios under suitable conditions of time, temperature and pressure wherein the molar ratios of reactants vary form equimolar to more than molar to less than molar, at temperatures varying from about 50 to about 250 C. and the pressure is autogenous or varies from atmospheric to about 100 psi for times varying from about an hour to about 48 hours thereby producing the desired ester additive product said product containing polymeric structures having ester functions and long-chain hydrocarbyl groups independently and regularly spaced along the polymer backbone and wherein hydrocarbyl is selected from the group consisting of alkyl alkenyl, aryl, alkaryl, aralkyl and wherein said additive product is (5) optionally post reacted with suitable amines or alcohols or a mixture of such amines and alcohols.

2. The ester additive product of reaction of claim 1 wherein said additive product is prepared from monomers selected from the group consisting of (1) anhydrides and long-chain epoxides, (2) anhydrides, epoxides and activated epoxides and polyepoxides, a polyanhydride or activated anhydride and a long-chain epoxide.

3. The ester additive products of the reactions of claim 2 wherein said products of reaction described therein as prepared from (1) anhydrides, long-chain epoxides and polyepoxides, (2) an anhydride, epoxide and a polyanhydride or activated anhydride and long-chain epoxides said monomers respectively selected from the group consisting of 1,2-epoxyoctadecane, 1,2-epoxy C14-C20 alkane, 1, 4, butanediol digllycidyl ether, neopentanediol diglycidyl ether, propolene glycol digllycidyl ether, bis phenol A diglycidyl ether, trimethyl propane triglycidyl ether, epichlorohydrin, phthalic anhydride, 1-methy-5-norbornene-2,3-dicarboxylic anhydride, C18-C24 succinic anhydride pyromellitic dianhydride, and 3,3',4,4'-benzophenonetetracarboylic dianhydride.

4. The additive product of claim 1 wherein at least one of said monomers and optionally more than one, has a pendant hydrocarbyl group of at least $C_{12}$ or longer.

5. The additive product of claim 1 wherein the monomers are phthalic anhydride, 1,2-epoxyoctadecane and neopentanediol diglycidyl ether.

6. The additive product of claim 1 wherein the monomers are phthalic anhydride, 1,2-epoxyoctadecane and epichlorohydrin.

7. The additive product of claim 1 wherein the monomers are phthalic anhydride, 1,2-epoxyoctadecane and pyromellitic dianhydride.

8. A process of preparing a multifunctional low-temperature modifying distillate fuel polymeric and/or oligomeric ester product of reaction consisting of epoxide cross-linked or anhydride cross-linked oligomers/-polymers comprising polymerizing or oligomerizing a suitable combination of monomers selected from the group consisting of (1) one or more long-chain epoxides or diol equivalents, (2) one or more anhydrides or diacid equivalents, (3) one or more cross-linking agent selected from the group consisting of polyepoxide or polydiol, or polyanhydride or polyacid equivalent, or activated anhydride, and optionally a suitable reactive material selected from the group consisting of epoxy halides, diepoxides or dianhydrides in varying molar ratios under suitable conditions of time, temperature and pressure wherein the molar ratios of reactants vary from equimolar to more than molar to less that molar, at temperatures varying from about 50 to about 250° C. and the pressure is autogenous or varies from atmospheric to about 100 psi for times varying from about an hour to about 48 hours thereby producing the desired ester additive product said product containing oligomeric/polymeric structures having ester functions and long-chain hydrocarbyl groups independently and regularly spaced along the polymer backbone and wherein hydrocarbyl is selected from the group consisting of alkyl alkenyl, aryl, alkaryl, aralkyl and wherein said additive product is (5) optionally post reacted with suitable amines or alcohols or a mixture of such amines and alcohols.

9. The process of claim 8 wherein at least one of said monomers and optionally more than one, has a pendant hydrocarbyl group of at least $C_{12}$ or longer.

10. The process of claim 8 wherein the monomers are phthalic anhydride, 1,2-epoxyoctadecane and neopentane-diol diglycidyl ether.

11. The process of claim 9 wherein the monomers are phthalic anhydride, 1,2-epoxyoctadecane and epichlorohydrin.

12. The process of claim 9 wherein the monomers are phthalic anhydride, 1,2-epoxyoctadecane and pyromellitic dianhydride.

13. A fuel additive concentrate comprising a major amount of a liquid hydrocarbon solvent having dissolved therein a minor amount of a low-temperature modifying fuel additive product of reaction as claimed in claim 1.

14. The fuel additive concentrate of claim 13 wherein a volume of about 100 ml, contains about 10 g of said additive product of reaction dissolved therein.

15. The fuel additive concentrate of claim 13 wherein said solvent is selected from the group consisting of xylene, mixed xylenes and toluene.

16. A liquid hydrocarbyl fuel composition comprising a major amount of said fuel and a minor amount of a multifunctional low-temperature modifying distillate fuel polymeric and/or oligomeric ester additive product of reaction consisting of epoxide cross-linked or anhydride cross-linked oligomers/polymers prepared by polymerizing or oligomerizing a suitable combination of monomers selected from the group consisting of (1) one or more long-chain epoxides or diol equivalents, (2) one or more anhydrides or diacid equivalents, (3) one or more cross-linking agents, selected from the group consisting of polyepoxides, polyanhydrides, or activated anhydrides and (4) optionally a suitable reactive material selected from the group consisting of epoxy halides, diepoxides, and anhydrides in varying molar ratios under suitable conditions of time, temperature and pressure wherein the molar ratios of reactants vary from equimolar to more than molar to less than molar, at temperatures varying form about 50 to about 250 C. and the pressure is autogenous or varies from atmospheric to about 100 psi for times varying from about an hour to about 48 hours thereby producing the desired ester additive product said product containing polymeric structures having ester functions and long chain hydrocarbyl groups independently and regularly spaced along the polymer backbone and wherein hydrocarbyl is selected from the group consisting of alkyl alkenyl, aryl, alkaryl, aralkyl and wherein said additive product is (5) optionally post reacted with suitable amines or alcohols or a mixture of such amines and alcohols.

17. The fuel composition of claim 16 wherein the additive product of reaction is prepared from monomers selected from the group consisting of (1) long-chain anhydrides, epoxides and polyepoxides, (2) anhydrides epoxides and activated epoxides, (3) polyanhydrides, activated anhydrides and long-chain epoxides or are (4) post reacted oligomeric or polymeric esters.

18. The fuel composition of claim 17 wherein the additive products of reaction described therein are prepared from (1) anhydrides, long-chain epoxides and polyepoxides, (2) anhydrides, epoxides and activated epoxides, (3) polyanhydrides, activated anhydrides and long-chain epoxides said monomers respectively selected from the group consisting of 1,2-epoxyoctadecane, 1,2-epoxy C14–C20 alkane, 1,4, butanediol diglycidy ether, neopentanediol diglycidyl ether, propolene glycol digllycidyl ether, bis phenol A diglycidyl ether, trimethyl propane triglycidyl ether, epichlorohydrin, phthalic anhydride, 1-methy-5-norbornene-2,3-dicarboxylic anhydride, C18–C24 succinic anhydride pyromellitic dianhydride, and 3,3',4,4'-benzophenonetetracarboylic dianhydride.

19. The fuel composition of claim 16 wherein at least one of said monomers and optionally more than one, has a pendant hydrocarbyl group of at least $C_{12}$ or longer.

20. The fuel composition of claim 16 wherein the monomers are phthalic anhydride, 1,2-epoxyoctadecane and neopentanediol diglycidyl ether.

21. The fuel composition of claim 16 wherein the monomers are phthalic anhydride, 1,2-epoxyoctadecane and epichlorohydrin.

22. The fuel composition of claim 16 wherein the monomers are phthalic anhydride, 1,2-epoxyoctadecane and pyromellitic dianhydride.

23. The fuel composition of claim 16 comprising from about 0.001 to about 10% by weight based on the total weight of the composition of the ester additive product of reaction.

* * * * *